US005167342A

United States Patent [19]

Merritt

[11] Patent Number: 5,167,342

[45] Date of Patent: Dec. 1, 1992

[54] TRASH BAG

[76] Inventor: Michael R. Merritt, c/o 5848 Innskeep Rd., Washington C.H., Ohio 43160

[21] Appl. No.: 787,034

[22] Filed: Nov. 4, 1991

[51] Int. Cl.[5] ..... B65F 1/06

[52] U.S. Cl. ..... 220/404; 220/909; 220/23.4; 220/23.83; 383/33; 383/38

[58] Field of Search ..... 220/404, 23.4, 909, 220/908, 23.83, 23.86; 383/33, 38

[56] References Cited

U.S. PATENT DOCUMENTS

| | | | |
|---|---|---|---|
| 1,850,920 | 3/1932 | Calkins | 383/38 |
| 2,426,843 | 9/1947 | Phair et al. | 383/38 |
| 2,757,699 | 8/1956 | Fancher et al. | 383/38 |
| 3,021,001 | 2/1962 | Donofrio | 220/23.4 |
| 3,640,450 | 2/1972 | Lieberman | 383/38 |
| 3,648,875 | 3/1972 | Lundgren | 220/404 |
| 4,026,340 | 5/1977 | Sobolik | 383/33 |
| 4,682,699 | 7/1987 | Ertley | 220/23.4 |
| 4,750,639 | 6/1988 | Schaerer | 220/410 |
| 4,759,467 | 7/1988 | Byrne | 220/404 |
| 5,062,540 | 11/1991 | Jenkins | 220/23.4 |

FOREIGN PATENT DOCUMENTS

| | | | |
|---|---|---|---|
| 2207120 | 1/1989 | United Kingdom | 383/38 |

*Primary Examiner*—Stephen Marcus
*Assistant Examiner*—S. Castellano
*Attorney, Agent, or Firm*—Biebel & French

[57] ABSTRACT

An improved trash bag is provided for use in conjunction with trash containers, with the trash bag having formed therein a plurality of compartments, each compartment having an upper portion, a side wall portion, and a skirt portion. Members for closing each compartment are provided. Additionally, cooperative handle members may be disposed on opposite sides of the skirt portion. Modified embodiments of the invention are disclosed wherein the trash bag has its compartments arranged in more than one row, or in configurations adaptable to containers other than of a square or roughly rectangular configuration.

9 Claims, 4 Drawing Sheets

TRASH BAG

BACKGROUND OF THE INVENTION

The present invention relates generally to a trash bag, and more particularly, to such a device which can be used in conjunction with recycling efforts.

For both environmental and economic reasons, it has become desirable to sort trash into various types of products, such as glass, aluminum, paper, and garbage such as food. This has many advantages, at least one of which is that it facilitates recycling. A number of attempts have been made over the past several decades to provide products which can be used to facilitate recycling. Most efforts thus far have involved either inventions in compartmentalized trash receptacles, or to a much lesser extent compartmentalized trash bags.

For example, Lundgren, U.S. Pat. No. 3,648,875 discloses a device having a group of receptacles useful for sorting garbage. Sipher, U.S. Pat. No. 3,720,346 discloses a compartmented trash receptacle in which each separate compartment is used for the collection of different trash materials. A separate bag is used with each compartmented receptacle. Deane et al, U.S. Pat. No. 3,856,173 discloses an arrangement of cans on a rack for use in sorting trash. Similarly, Kostel, U.S. Pat. No. 3,904,218 discloses a group of cans on a platform said to be useful in sorting trash. Other forms of compartmentalized trash receiving devices include Pluss, U.S. Pat. No. 4,114,776, Johnson, U.S. Pat. No. 3,893,615, Strawder, U.S. Pat. No. 4,905,853 and Heller, U.S. Pat. No. 4,874,111.

An example of an invention disclosing a compartmental-ized trash bag is Scheurer, U.S. Pat. No. 4,750,639. That particular patent discloses an arrangement for the presorting of household garbage comprising a garbage sack, which sack consists of at least two sectional sacks having different distinguishing markings and which two sectional sacks form separate garbage compartments which can be separated from each other.

Unfortunately, in each of the aforementioned trash collection arrangements, limitations are present with respect to a prearranged correspondence between the trash container and the trash bag. Additionally, even in the bag disclosed in Scheurer, it can be appreciated that problems will present themselves when the single garbage sack is removed from the container and separated into the various smaller sacks, with respect to the overflow or accidental spillage of the contents of the various smaller receptacles.

It is thus apparent that the need exists for an improved trash bag or the like which exhibits greater adaptability to various container shapes and sizes, and which provides for a neater overall collection of the trash to be recycled.

SUMMARY OF THE INVENTION

The problems associated with prior recycling containers and trash bags are overcome in accordance with the present invention by forming an improved trash bag having a plurality of compartments, with each compartment comprising an uppper portion, a side wall portion, and a skirt portion. Each compartment's upper portion includes means for closing that particular compartment. Additionally, each of the side wall portions are attached adjacent to the respective upper portion of that particular compartment. Still further, each of the skirt portions associated with each respective compartment are attached adjacent that compartment's upper portion and depend downwardly therefrom. The skirt portion partially covers the side wall portion and also has formed within the skirt portion means for detachably connecting adjacent compartments of the improved trash bag.

The improved trash bag of this invention may have its compartments arranged in more than one row. Furthermore, the upper portion includes reinforcement seams. Still further, each of the compartment's skirt portions comprise a first set of cooperative handle means disposed on opposite sides of the skirt portion. Additionally, there is a second set of cooperative handle means disposed on the skirt portions of adjacent compartments.

There is also disclosed the combination of a refuse container and the improved trash bag which has a plurality of compartments, with each compartment including an upper portion, a side wall portion, and a skirt portion.

There is also disclosed an improved trash bag having a plurality of compartments, with each compartment having an upper portion, each of which upper portions having means for closing the trash bag, a sidewall portion, each of the sidewall portions attached adjacent an upper portion, and a skirt portion, each of the skirt portion attached adjacent an upper portion and depending downwardly therefrom, and each of the compartments, separable from the trash bag along a line intermediate the upper portions. In one modified embodiment the compartments are separable from the trash bag along a line adjacent the upper portions which line encircles each compartment. In another modified embodiment, the compartments are separable from the trash bag along a line which separates a compartment's upper portion from adjacent compartments with that line of separation also extending along the two side edges of the compartment's skirt portion and also along the bottom edge thereof.

It is the primary object of the present invention to provide a trash bag for the pre-sorting of household garbage in particular, which meets all the requirements necessary for separating the refuse components already in the household without interfering in the manner of handling to which the user is accustomed, and without having to replace all the existing trash containers.

Another object of the present invention is to provide an improved trash bag which can be utilized so as to form a flexible number of compartments in containers of various shapes and sizes.

Other objects and advantages of the invention will be apparent from the following description, the accompanying drawings, and the appended claims.

DETAILED DESCRIPTION OF THE INVENTION

Figure 1:
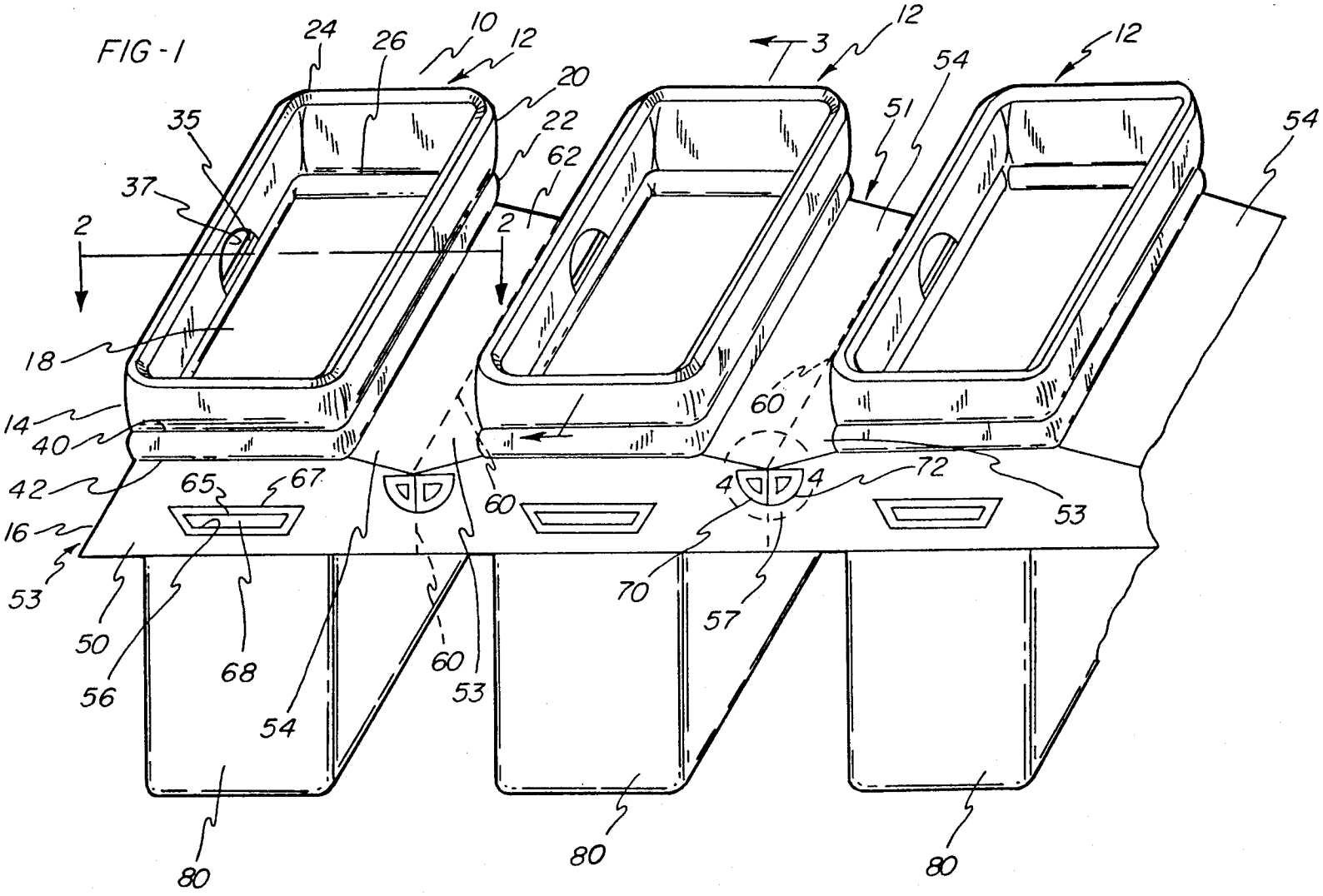
FIG. 1 is a perspective view of an improved trash bag oriented in operable configuration in accordance with the present invention.

Having reference to the drawings, direction is first directed to FIG. 1 which illustrates an improved trash bag structure embodying this invention, installed in operative relationship to a trash container, with the invention being designated generally by the numeral 10. The trash bag 10 of this invention is comprised of a plurality of compartments 12. Each compartment is formed having an upper portion 14, a skirt portion 16, and a side wall portion 18.

Figure 2:
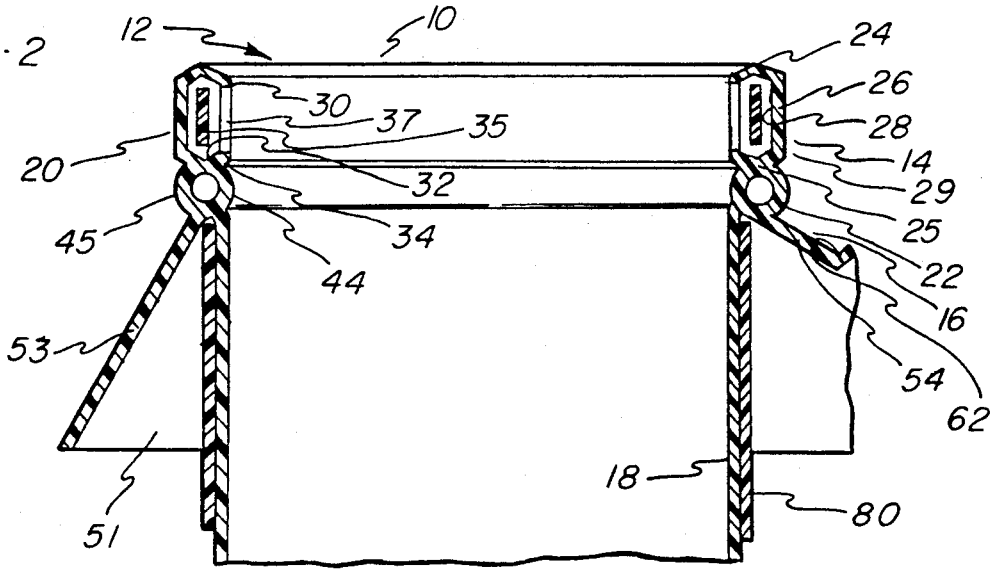
FIG. 2 is a partial vertical sectional view on an enlarged scale taken along line 2—2 of FIG. 1.
Figure 3:
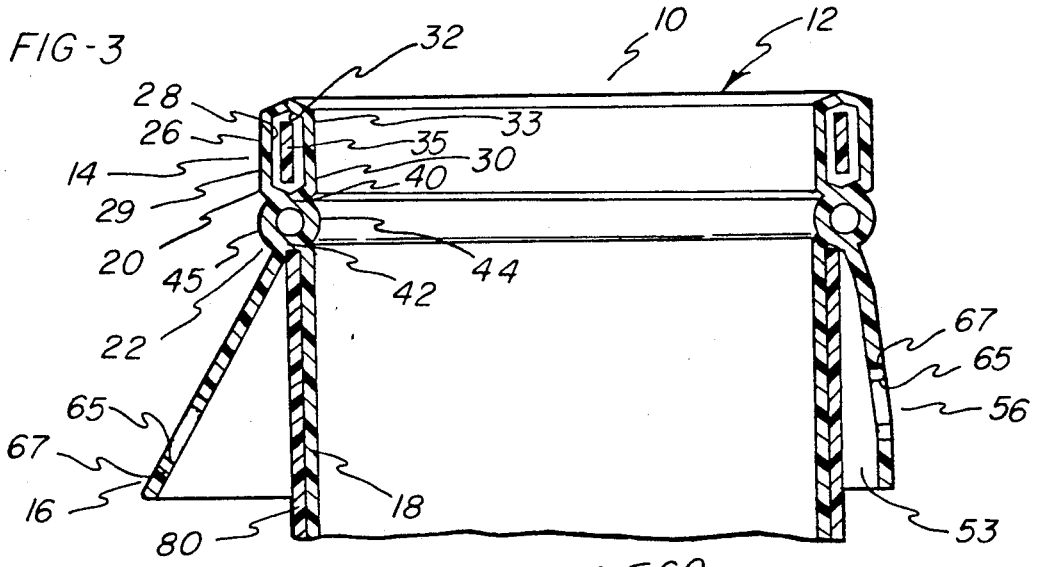
FIG. 3 is a partial vertical sectional view on an enlarged scale taken along line 3—3 of FIG. 1.

As can be seen better in FIGS. 2 and 3, the upper portion 14 has formed therein a closure compartment 20 and a reinforcement section 22. The closure compartment 20 comprises a closure compartment top edge 24 serves as the uppermost edge of the upper portion 14 of each compartment 12 of trash bag 10. The closure compartment 20 also comprises a closure compartment bottom edge 25. Connecting the closure compartment top edge 24 and closure compartment bottom edge 25 are two side wall portions, the first outer disposed side wall portion 26 comprised of an inner side wall 28 and an outer side wall 29, and the first inner disposed side wall portion 30 comprised of an inner side wall 32 and an outer side wall 33.

Contained within closure compartment 20 preferably is the means for closure of the compartment, with the closure means 35 preferably being a draw string of the type associated with plastic or paper bags. Access to the closure means 35 for the user of the improved trash bag 10 is facilitated through a closure means aperture 37 formed on the first inner disposed side wall portion 30, as can best be appreciated by a comparison of FIGS. 1 and 2.

As can best be appreciated by FIGS. 1, 2 and 3, the reinforcement section 22 of upper portion 14 comprises a first reinforcement seam 40 and a second reinforcement seam 42 which preferably extend completely around the circumference of the upper portion 14 of each compartment 12. The reinforcement section 22 may be formed having a reinforcement section inner side wall 44 and a reinforcement section outer side wall 45 as shown in the drawings or the reinforcement section may be formed having a unitary sheetform member spanning the distance between the first reinforcement seam 40 and second reinforcement seam 42.

With respect to the skirt portion 16, each compartment has a skirt portion 16 having a first end portion 50 and a second end portion 51. Additionally, each compartment has its respective skirt portion 16 having a first side portion 53 and a second side portion 54 which are on opposite sides of the compartment. The skirt portion is attached adjacent the upper portion and depends downwardly therefrom. The skirt may also depend outwardly from its attachment point. The skirt may be either single or double wall construction.

Figure 4:
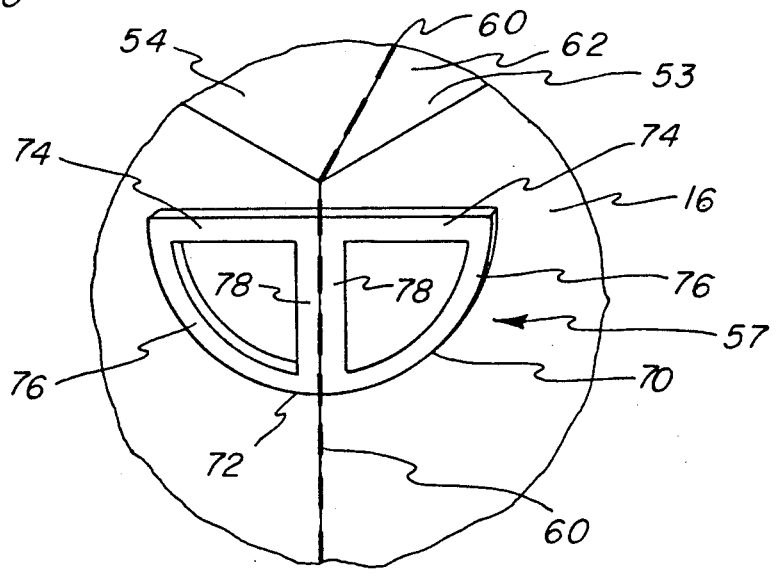
FIG. 4 is a perspective view on an enlarged scale of the area delineated within the line 4—4 of FIG. 1.

Preferably in each of the end portion 50 and second end portion 51 there is formed a first means for grasping 56, with this first means for grasping 56 being located near the center of the first and second end portions. Additionally, there is a second means for grasping 57 formed, as can be seen in FIGS. 1 and 4, along the juncture between adjacent compartments 12, and more particularly along the juncture between adjacent first end portions associated with adjacent compartments. Along the juncture between adjacent compartments 12 is a perforated seam 60, or other type seam that allows separation which seam extends from the first end portion across a valley 62, which valley corresponds to the juncture of directly adjacent first side portion and second side portion of adjacent compartments, and terminates at the lower edge of the second end portion 51.

With respect to the first means for grasping 56, there preferably is formed a first reinforcement seam 65 and a second reinforcement seam 67, such that by inserting a user's hand through the opening 68 formed in the first grasping means 56 a particular compartment 12 may be lifted from a trash container without risking contact of the user with the inside of the container, and consequently inadvertent contact with the refuse. The risk of such contact is further minimized by the ability to close that particular compartment 12 by the draw string 35 or other closure means.

The second means for grasping the improved trash bag, which second grasping means 57 can best be appreciated in FIG. 4, discloses a first handle component 70 and a second handle component 72. Each of these handle components comprise a top wall member 74, a curved wall member 76, and an upright wall member 78 with an aperture formed within the three wall members to assist in the easy grasping and subsequent tearing of the trash bag along perforated seam 60 so as to separate the various compartments 12. This second grasping means is preferably welded or otherwise securely attached to the trash bag of this invention, if it is not formed as a unitary component of the bag itself.

Both first and second means for grasping could alternatively be in the form of handles with knockout centers. Additionally, either could serve to facilitate attachment of the trash bag to the bag holding apparatus or to recycling equipment, so as sorters. Also, they could be located on the inside of the skirt. Furthermore, they could both be components of a band on the outside of the skirt which would encompass the bag.

FIGS. 1, 2 and 3 disclose the use of the improved trash bag 10 of this invention in combination with a conventional bag holding apparatus 80 which bag holding apparatus 80 may be a frame unit or a trash container of almost any configuration such as a square or rectangular can, or cylindrical container. The skirt portion partially covers the side wall portion and the container as its side wall or frame disposed between the side wall portion of the trash bag and the skirt portion of the trash bag.

As shown in FIG. 1, the improved trash bag made in accordance with this invention may be formed in a single row with perforated seams separating the individual compartments. The trash bag of this invention thus permits the utilization in one large container of a single or a plurality of compartments depending upon the number of compartments desired to be used in connection with recycling.

Figure 5:
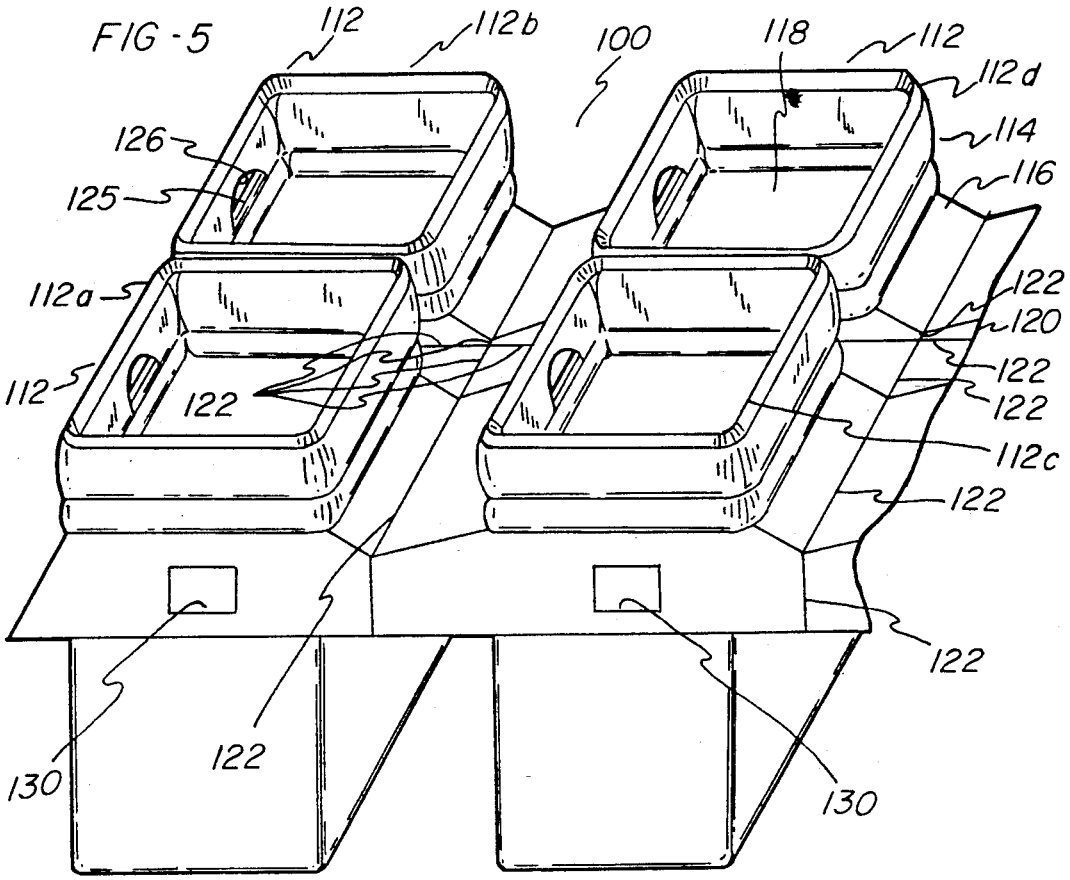
FIG. 5 is a perspective view somewhat similar to FIG. 1, but of a modified embodiment of the invention.
Figure 6:
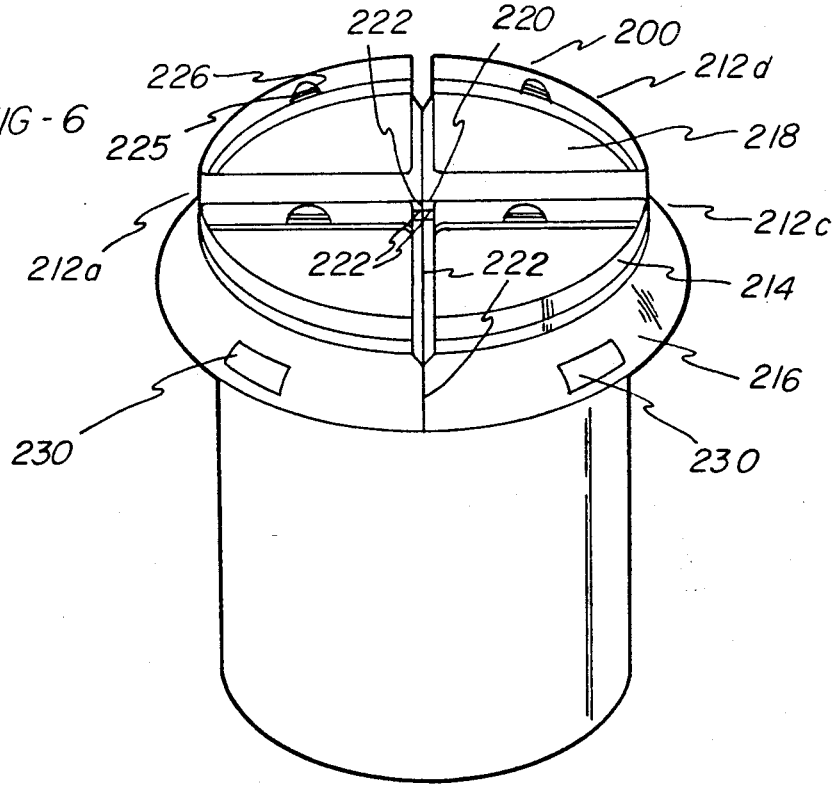
FIG. 6 is a perspective view of another modified embodiment of the invention.

Thus, for example a single trash bag compartment could be used in a container, or three compartments could be utilized side by side as shown in FIG. 1, or other modified embodiments of the invention could be manufactured in either plastic or paper similar to the embodiments shown in FIGS. 5 and 6.

FIG. 5 discloses a modified trash bag 100 having compartments 112, with those compartments being further delineated as 112A–112D, for a trash bag formed having two adjacent rows. Each of the compartments 112 of the modified trash bag 100 comprise upper portion 114, a skirt portion 116, and a side wall portion 118 similar to the corresponding components of the trash bag of FIG. 1. Between the two rows of trash bag compartments 112 is formed a modified end portion 120, with the modified end portions of compartment 112A and 112B being separated by a perforated seam 122, as are adjacent compartments 112A and 112C, and 112B and 112D. Each of the compartments has contained therein means for closure 125, with a pair of closure means apertures 126 associated with each compartment similar to the arrangement shown in FIG. 2. Handle means 130 are also provided with this modified trash bag.

In this modified embodiment of the invention, a square container may utilize one, two or four compartments. Similarly, a roughly rectangular container could utilize two, six or other even numbers of compartments greater than six. Thus, a large container could be serviced by a single trash bag made in accordance with the invention, with the size of the trash bag and the size of the compartments determining the actual number of distinct recycling compartments which could be made available.

Still another modified embodiment of the invention is shown in FIG. 6 wherein this modified trash bag 200 is formed having a plurality of compartments 212, with each of these compartments being designated 212A–212D. Each of the compartments has an upper portion 214, a skirt portion 216, and a side wall portion 218.

As was the case in the first modified embodiment of the invention, there is disclosed in the trash bag shown in FIG. 6 a modified end portion 220 located on the skirt 216 of that embodiment. Separating each of the compartments 212A–D is a perforated seam 222. Means for effecting closure of the trash bag 225 are shown with these closure means being able to be grasped through the cooperation of the closure means apertures 226. Handle means 230 are also provided with this modified trash bag. In this particular embodiment of the invention, a cylindrical or oblate trash container may be utilized for purposes of recycling of more than one particular refuse component.

Figure 7:
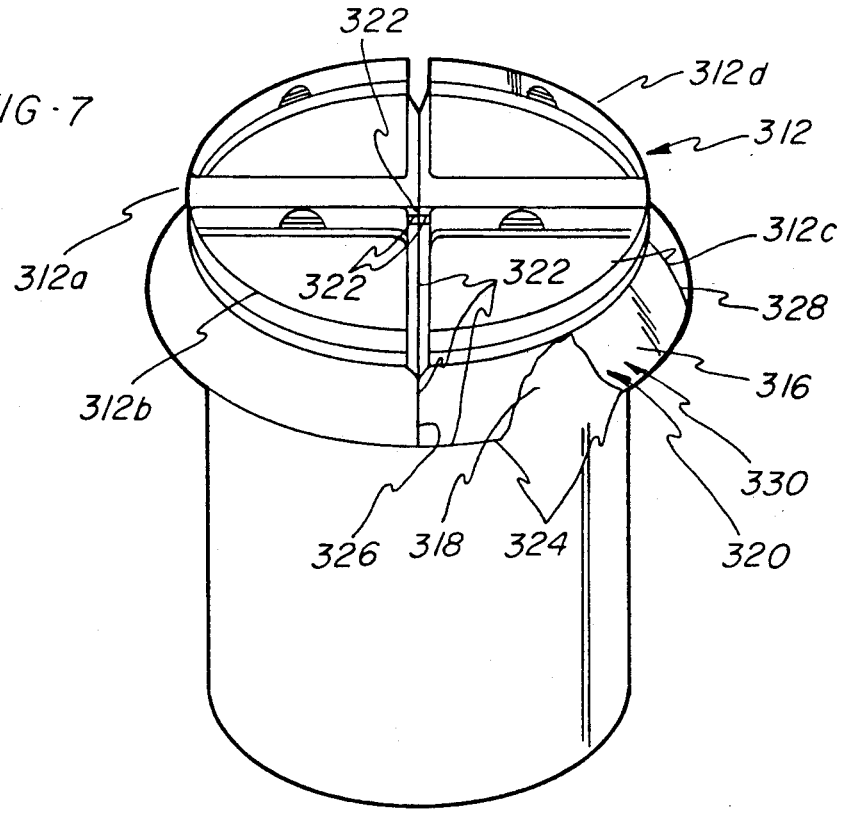
FIG. 7. is a perspective view similar to FIG. 6, but of a further modified embodiment of the invention.

Yet another modified embodiment of the invention is shown in FIG. 7. In this embodiment, the compartments 312, with each of these compartments being designated 312A–312D, may be separated along perforations 322 either individually or jointly from the skirt 316 appended to the container. The advantage associated with this embodiment of the invention is that the entire bag need not be removed in order to dispose of one filled compartment.

As can be seen, the skirt 316 has an inner wall 318 and outer wall 320. A given compartment can be detached along the perforation 322 between itself and the other compartments. The detachment continues along the outer wall 320, which while remaining secured to the container being removed, is detached from the skirt's inner wall 318 along the bottom edge 324 and along the two side edges 326, 328 of the skirt portion 330 associated with the container to be removed. Thus, the remaining compartments are held within the container by the inner skirt encircling the upper rim of the container.

Figure 8:
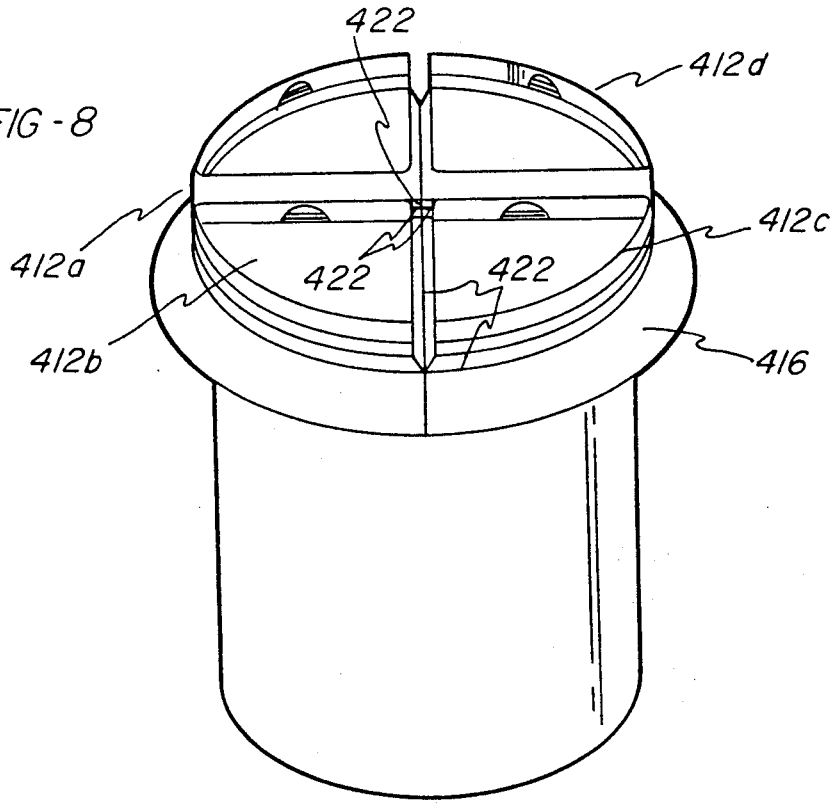
FIG. 8 is a perspective view similar to FIG. 6, but of a still further modified embodiment of the invention.

Still another modified embodiment of the invention is shown in FIG. 8. In this embodiment, the compartments 412 may be separated along perforations 422 from adjacent compartments as well as the skirt 416, regardless of whether the skirt has one or two walls. The advantage is the same as with the previous modification. However, it should be recognized that the remaining compartments are held within the container by the entire skirt, whether of single or double ply construction, encircling the upper rim of the container.

The improved trash bag of this invention permits a single container to be utilized for recycling more than one refuse component. One of the problems with current recycling efforts is that the individual typically is forced to utilize separate containers for separate refuse components. Thus, one trash can is dedicated to metal, while another is dedicated to glass. Unfortunately, with a number of various recycling materials and with differing percentages of respective refuse component consumption, it is often impossible to regiment and standardize consumption. The improved trash bag of this invention facilitates recycling by adopting a much more flexible approach to the recycling efforts of individual users.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An improved trash bag comprising a plurality of compartments, with each compartment comprising an upper portion, each of said upper portions comprising means for closing said trash bag, a sidewall portion, each of said sidewall portions attached adjacent one of said upper portions, and a skirt portion, each of said skirt portions attached adjacent said one of said upper portions and depending downwardly therefrom, said skirt portion partially covering said sidewall portion, said skirt portion having formed therein means for detachably connecting adjacent compartments, said compartment's skirt portions comprising a first set of cooperative handles disposed on opposite sides of said skirt portion.

2. The trash bag according to claim 1 wherein said trash bag has its compartments arranged in more than one row.

3. The trash bag according to claim 1 wherein said upper portion comprises reinforcement seams.

4. The trash bag according to claim 1 which includes a second set of cooperative handles disposed on the skirt portions of adjacent compartments.

5. In combination, a refuse container and an improved trash bag comprising a plurality of compartments, with each compartment comprising an upper portion, each of said upper portions comprising means for closing said trash bag, a sidewall portion, each of said sidewall portions attached adjacent one of said upper portions, and a skirt portion, each of said skirt portions attached adjacent said one of said upper portions and depending downwardly therefrom, said skirt portion partially covering said sidewall portion, said skirt portion having formed therein means for detachably connecting adjacent compartments, said container having a sidewall disposed between said sidewall portion and said skirt portion, each of said compartment's skirt portions comprising a first set of cooperative handles disposed on opposite sides of said skirt portion.

6. The trash bag according to claim 5 wherein said trash bag has its compartments arranged in more than one row.

7. The trash bag according to claim 5 wherein said upper portion comprises reinforcement seams.

8. The trash bag according to claim 5, which includes a second set of cooperative handles disposed on the skirt portions of adjacent compartments.

9. An improved trash bag comprising a plurality of compartments, with each compartment comprising an upper portion, each of said upper portions comprising means for closing said trash bag, a sidewall portion, each of said sidewall portions attached adjacent, one of said upper portions and a skirt portion, each of said skirt portions attached adjacent said one of said upper portions and depending downwardly therefrom, each of said compartments separable from said trash bag along a line intermediate said upper portions and extending in a direction perpendicular to the axial direction of the compartment.

* * * * *